United States Patent [19]

Perry

[11] 4,196,573

[45] Apr. 8, 1980

[54] NOVELTY YARN AND METHOD

[75] Inventor: Lamuel D. Perry, Albemarle, N.C.

[73] Assignee: Tuscarora Yarns, Inc., Mount Pleasant, N.C.

[21] Appl. No.: 968,457

[22] Filed: Dec. 11, 1978

[51] Int. Cl.[2] ..... D02G 3/34

[52] U.S. Cl. ..... 57/207; 57/6; 57/12; 57/208

[58] Field of Search ..... 57/3, 6, 12, 91, 206–208, 57/229, 210, 227

[56] References Cited

U.S. PATENT DOCUMENTS

| | | | |
|---|---|---|---|
| 2,211,643 | 8/1940 | Bry | 57/207 |
| 2,279,297 | 4/1942 | Bry | 57/207 |
| 2,332,395 | 10/1943 | Nutter et al. | 57/207 X |
| 2,731,789 | 1/1956 | Holder | 57/12 |
| 3,076,307 | 2/1963 | Marshall | 57/207 |
| 3,166,884 | 1/1965 | Steiner et al. | 57/229 X |
| 3,334,483 | 8/1967 | Radcliffe | 57/12 X |
| 3,357,171 | 12/1967 | Marshall | 57/207 X |
| 3,388,545 | 6/1968 | Cannon et al. | 57/207 |
| 3,763,640 | 10/1973 | Nagel et al. | 57/6 |
| 3,945,189 | 3/1976 | Allen | 57/12 |

OTHER PUBLICATIONS

Technical Information Bulletin No. 17; "Fancy Yarns"; International Wool Secretariat; Jan. 1975; pp. 1–58.

*Primary Examiner*—John Petrakes

*Attorney, Agent, or Firm*—Bell, Seltzer, Park & Gibson

[57] ABSTRACT

A unique and appealing novelty yarn characterized by having random size loops disposed at random locations therealong is economically produced on conventional textile machinery, thus avoiding the need for specialized and expensive machinery such as a novelty twister. The yarn includes a foundation strand and an effect strand wrapped about the foundation strand, with certain areas of the effect strand forming random length multiple layer deposits at randomly spaced locations along the foundation strand, and with portions of the effect strand projecting from the multiple layer deposits and forming random size loops. A binder strand wrapped about the foundation and effect strands binds the effect strand to the underlying foundation strand.

36 Claims, 12 Drawing Figures

NOVELTY YARN AND METHOD

FIELD OF THE INVENTION

The present invention relates to a unique and appealing novelty yarn characterized by having effect loops of random size distributed at random locations along the yarn, and to a method for producing such a yarn.

BACKGROUND OF THE INVENTION AND PRIOR ART

Novelty yarns are conventionally produced on specialized machinery, such as a novelty twister, wherein several separate pairs of feed rolls are employed for feeding two or more yarns together at different rates in such a manner that certain of the yarns serve as "effect" yarns and become wrapped about other yarns to form novelty effects such as knops, loops, curls, etc. The thus formed yarn is usually twisted again in a subsequent twisting operation while a fine binder yarn is applied to hold the effect yarn or yarns in place.

By way of example, a conventional method of producing a loop yarn on a novelty twister involves delivering an effect yarn from a pair of delivery rolls in an overfed condition between a pair of advancing base yarns so that the overfed effect yarn forms circular loops which are trapped between the two base yarns. In a subsequent twisting operation a binder yarn is applied to the yarn to stabilize the yarn and hold the loops in place.

The relatively high cost of the specialized novelty twisters required in conventional novelty yarn methods and the relatively slow operating speed and limited versatility thereof significantly increase the production cost of novelty yarns produced by these methods as compared to conventional yarns and often cause the novelty yarns to be of limited availability.

Allen U.S. Pat. No. 3,945,189 discloses a method for producing a novelty yarn without using a novelty twister. This method uses a conventional spinning frame to produce a knop yarn, i.e. a yarn having prominent bunches of effect yarn arranged at irregular intervals along its length. In accordance with this method an effect yarn is supplied to a foundation yarn advancing from the drafting zone to the spindle of a spinning frame and the tension of the effect yarn is adjusted so that the effect yarn oscillates with respect to the advancing foundation yarn and forms irregular knops on the foundation yarn made up of layers of the effect yarn.

The present invention, like the method of the Allen patent, is concerned with producing a novelty yarn on conventional textile equipment and without using a novelty twister. However, the present invention is concerned with producing a yarn of a distinctly different type and appearance from that of the Allen patent. More particularly, the present invention is concerned with producing a unique and appealing loop-type yarn characterized by having effect loops of random size distributed at random locations along the yarn. The Allen patent, on the other hand, is not concerned with a yarn having loops thereon, but rather is concerned solely with producing a novelty yarn having knops or elongated knops thereon.

A publication of the International Wool Secretariat, "Technical Information Bulletin No. 17, Fancy Yarns" January, 1975, gives a further and considerably more detailed description of the method and resulting knop yarns described in the Allen patent. This publication also discloses that loop yarns and boucle yarns can also be produced by methods related to the knop yarn method. As described therein, the knop yarn produced as in the Allen patent is used as a starting material and subjected to subsequent processing operations in order to produce loop or boucle type yarns.

The novelty yarn of the present invention differs fundamentally from the loop or boucle yarns described in this publication. As will become readily apparent from the description which follows, the method by which the novelty yarn of the present invention is produced, as well as the resulting yarn, differ in several very significant respects from the methods and yarns disclosed in the above noted prior art.

SUMMARY OF THE INVENTION

The unique loop-type novelty yarn of the present invention is produced in a single step operation on conventional yarn processing machinery, such as a spinning frame, and provides significant economical advantages over the methods heretofore known for producing novelty yarns having loops thereon. By using machinery which is already available in a yarn mill, the present method enables a manufacturer of conventional yarns to obtain enhanced utilization of his existing machinery and to broaden his product line to include a unique and appealing new novelty yarn. This is accomplished without requiring a commitment of substantial capital and floor space for specialized novelty yarn machinery, as would be necessary with conventional methods.

The novelty yarn of the present invention is characterized by having random size loops disposed at random along the yarn. The randomness of the size and distribution of the loops totally avoids the undesirable patterning which may be observed in fabrics made of novelty yarns produced in the conventional manner on novelty twisters where the novelty areas may occur at regular repeating intervals.

The novelty yarn of the present invention includes a foundation strand with one or more effect strands wrapped about the foundation strand to form random length multiple layer deposits of effect strand at randomly spaced locations along the foundation strand and with portions of the effect strand projecting outwardly from the multiple layer deposits and forming random size loops. A binder strand wrapped about the foundation strand and the effect strand serves to bind the effect strand to the underlying foundation strand.

Novelty yarns of this construction can be produced by the method of the present invention with numerous variations of appearance. For example, the average size of the loops formed along the yarn can be adjusted as desired from relatively small loops to relatively large loops. The effect strand may be either a spun yarn or a continuous multifilament yarn, or if desired, the yarn may contain a plurality of effect strands of either the same or of differing characteristics. Novel variations of appearance can also be obtained from variations in the foundation strand. For example, the foundation strand may be formed either of spun staple fibers, continuous filaments, or mixtures of staple fibers and continuous filaments. Further variations can be obtained by using novelty yarns, as for example slub yarns as the effect strand, the foundation strand, or both.

The unique novelty yarn of the present invention is produced by advancing the foundation strand along a predetermined path of travel through a twisting zone and imparting twist to the foundation strand, while directing an effect strand onto the foundation strand in the twisting zone and causing the effect strand to move in an oscillating manner along the foundation strand and to become wound about the foundation strand while at random intervals forming outwardly projecting loops of random size along the foundation strand. A binder strand is directed onto the foundation and effect strands while still in the twisting zone and the binder strand is caused to become wound about the yarn so as to bind the effect strand to the underlying foundation strand.

To form loops of effect strand along the foundation strand in accordance with the method of this invention, it is highly important that the effect strand be under very low tension as it is directed onto the advancing foundation strand. This is accomplished by minimizing contact of the effect strand with friction surfaces as the effect strand is delivered from its supply source to the foundation strand. Desirably, the effect strand is directed along an essentially unrestrained path of travel from its supply source until it passes through a guide located adjacent the foundation strand. This results in the effect strand being in a nearly tensionless condition as it is delivered to the foundation strand.

The method of this invention may be carried out on various conventional types of yarn processing machinery. For example, the process may be conveniently carried out on a conventional spinning frame with the effect strand being directed onto the foundation strand between the delivery end of the drafting zone and the spindle and with the binder strand being directed onto the foundation and effect strands a short distance downstream from the introduction of the effect strand and prior to winding of the yarn at the spindle. The method can also be carried out on other conventional yarn processing machinery, such as twisters or open end spinning machines for example.

BRIEF DESCRIPTION OF THE DRAWINGS

Some of the features and advantages of the invention having been stated, others will become apparent as the description proceeds, when taken in connection with the accompanying drawings, in which.

DETAILED DESCRIPTION OF ILLUSTRATIVE EMBODIMENTS

Figures 1, 2, 3, 4, 5:
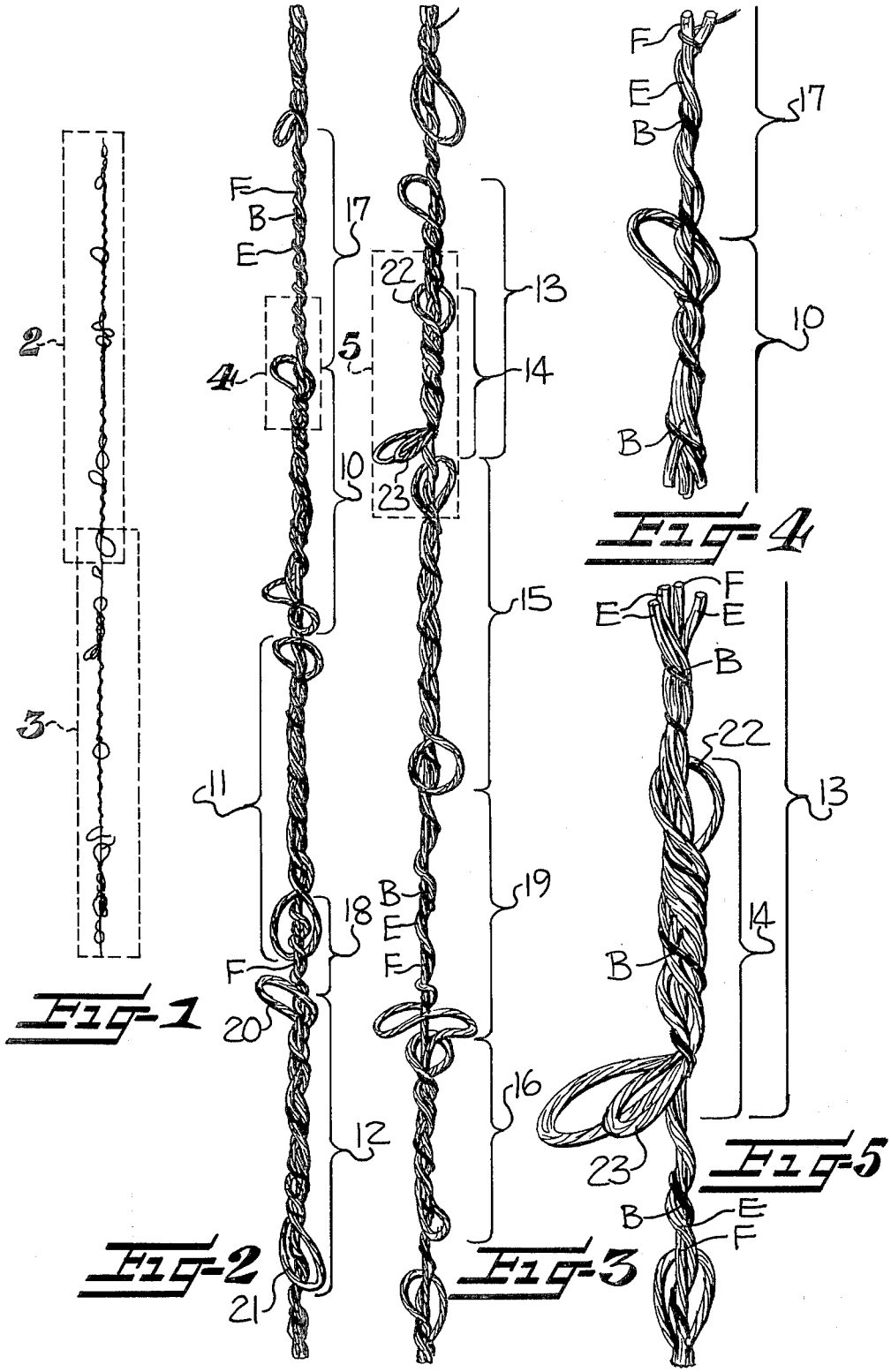
FIG. 1 illustrates a novelty yarn in accordance with the present invention and characterized by having effect loops of random size distributed at random locations along the yarn.
FIG. 2 is an enlarged scale view of that portion of the yarn designated in FIG. 1 by the numeral 2.
FIG. 3 is an enlarged scale view of that portion of yarn designated in FIG. 1 by the numeral 3.
FIG. 4 is a further enlarged scale view of that portion of the yarn designated in FIG. 2 by the numeral 4.
FIG. 5 is a further enlarged scale view of that portion of the yarn designated in FIG. 3 by the numeral 5.

Referring now more particularly to the drawings, FIG. 1 shows a novelty yarn in accordance with one embodiment of the present invention and wherein individual well-defined random sized loops are disposed at random locations along the yarn. As can be seen more clearly in the enlarged views of FIGS. 2 and 3 and in the greatly enlarged views of FIGS. 4 and 5, this yarn is comprised of a foundation strand F formed of spun staple fibers with a single effect strand E wrapped about the foundation strand throughout its length. In certain randomly disposed areas along the foundation strand the effect strand E reverses direction and is thus wound onto underlying windings of effect strand to form random length multiple layer deposits of effect strand around the foundation strand. Reference characters 10–16 in FIGS. 2–5 point out several random length multiple layer deposits of effect strand at randomly spaced locations along the foundation strand. The areas in which the effect strand forms multiple layer deposits about the foundation strand are separated by random length areas, such as those indicated by the reference characters 17–19, wherein the effect strand is wrapped in a single layer about the foundation strand. As is apparent from the drawings, the areas of the effect strand forming multiple layer deposits are relatively long and comprise the major portion of the length of the yarn, while the areas in which the effect strand is wrapped in a single layer are relatively short in comparison and occur relatively infrequently along the yarn.

The number of layers of effect strand in the multiple layer deposits may vary. As illustrated, a significant number of the multiple layer deposits are formed of three overlapping layers of effect strand, with each layer extending along the foundation strand in the opposite direction from each adjacent layer of effect strand. Reference characters 10, 11, 12, 15 and 16 indicate multiple layer deposits of this type. In other areas the effect strand may form more than three layers, such as is illustrated in FIGS. 3 and 5, for example, where a relatively short multiple layer deposit 14 is located on top of another, relatively longer multiple layer deposit 13.

The random size loops which appear at random locations along the yarn are formed from the effect strand E and emanate from the multiple layer deposits. While it is not readily apparent from FIG. 1 or from the actual yarn without magnification, the enlarged scale views of FIGS. 2–5 reveal that the loops occur in the multiple layer deposits at locations where the effect yarn reverses direction. Thus, in most instances, the loops project from the ends of the multiple layer deposits. Of course, where one multiple layer deposit is formed on top of another multiple layer deposit, the two deposits may not necessarily be individually discernible and the yarn will have the appearance of a relatively long multiple layer deposit with loops emanating from several locations therealong.

Considering FIGS. 2–5 more closely, it will be seen that most of the loops have the appearance of being joined to and extending from the yarn at a single location or point. The effect strand extends outwardly away from the foundation strand at the end of a multiple layer deposit, bends to form a loop, and then returns to and rejoins the yarn at the same end of the same multiple layer deposit. It will be further noted from the drawings that most of the multiple layer deposits have loops projecting from both ends thereof. For example, in FIG. 2 the multiple layer deposit identified by the reference numeral 12 has loops 20 and 21 projecting from opposite ends thereof. Similarly, in FIG. 5 the multiple layer deposit 14 has loops 22 and 23 also projecting from opposite ends of the multiple layer deposit. It will be further noted that in these instances, the loops project angularly outwardly from the foundation strand and extend away from one another in opposite directions. This further contributes to the unique, distinctive and appealing novelty appearance presented by yarns produced in accordance with this invention.

The effect strand E is relatively loosely wrapped about the foundation strand F. To hold the effect strand in place and prevent displacement thereof along the foundation strand, the yarn also includes a binder strand B which is wrapped about both the foundation strand F and the effect strand E. In the illustrated embodiment the binder strand B is a relatively fine denier continuous filament yarn of such a small size as compared to the effect strand and foundation strand as to be hardly discernible on the yarn. Indeed, even under the enlarged scale of FIGS. 2 and 3 the binder strand B is not readily visible, but is clearly seen in the greatly enlarged scale of FIGS. 4 and 5.

In the particular novelty yarn illustrated in the drawings, the foundation yarn has an S or left twist. The effect strand is wrapped about the foundation strand in a direction corresponding to the direction of twist in the foundation strand. Thus, in those areas where the wrapping of the effect strand can be clearly seen, such as the single layer areas indicated by the reference characters 17–19 for example, the effect strand E has the appearance of extending in the S direction about the foundation strand.

Preferably, and as illustrated the binder strand is also wrapped about the foundation strand in the same direction, i.e. a direction corresponding to the direction of twist in the foundation strand. The direction of wrapping of the effect strand and the binder strand about the foundation strand is the same throughout the length of the yarn. However, in those areas where the effect strand reverses direction to form multiple layer deposits, the effect strand will have the appearance of extending in the opposite, or Z direction about the foundation strand. However, it will be understood that the direction of wrapping of the effect strand about the foundation strand remains the same even in these random reversals of direction of the effect strand.

Where a spun yarn is employed as the effect strand, the direction of twist present in the effect yarn is preferably opposite that imparted to the foundation strand. This has been found to produce better, more well-defined loops, and to cause the loops to better project from the underlying foundation strand. Thus in the illustrated embodiment where the foundation strand has an S twist, an effect yarn having a Z twist would preferably be employed.

Figure 6:
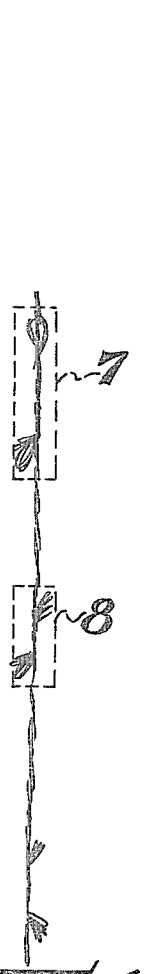
FIG. 6 illustrates another embodiment of a novelty yarn in accordance with the present invention and wherein the effect loops are characterized by a multiplicity of individual filament loops blossomed apart to present a fuzzy appearance to the loops.
Figure 7:
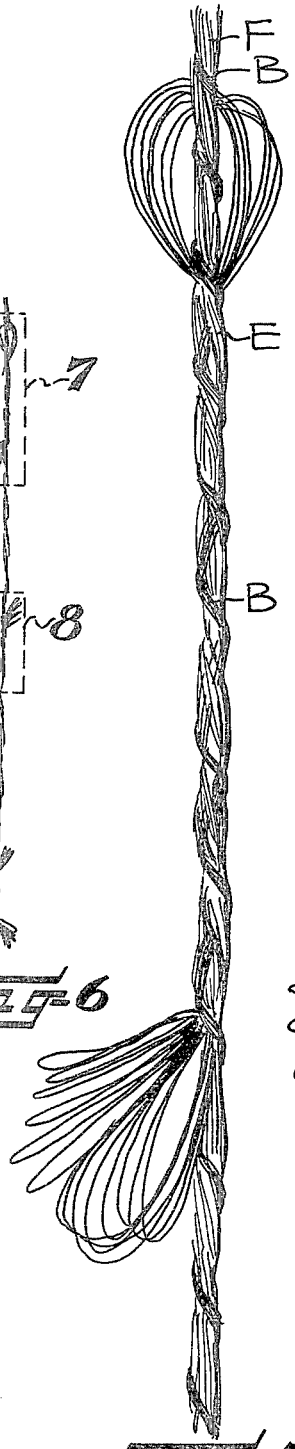
FIG. 7 is an enlarged scale view of that portion of the yarn designated in FIG. 6 by the numeral 7.
Figure 8:
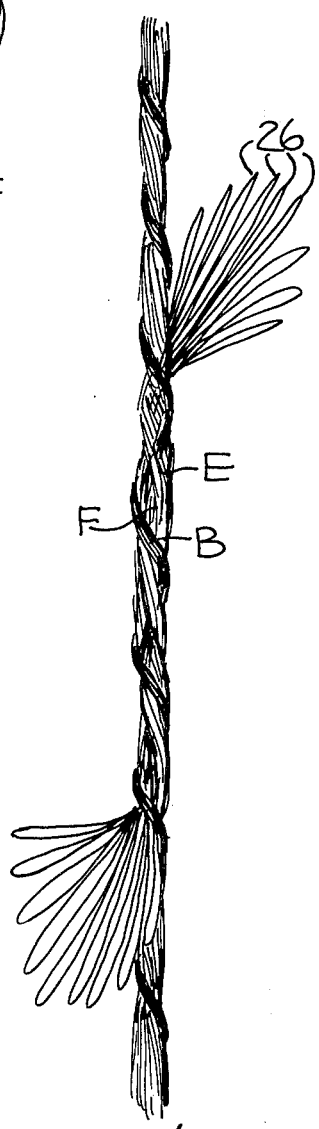
FIG. 8 is an enlarged scale view of that portion of the yarn designated in FIG. 6 by the numeral 8.

FIGS. 6–8 illustrate a novelty yarn produced in accordance with a second embodiment of the invention. This yarn is of essentially the same construction as the yarn previously described with reference to FIGS. 1–5, but has a distinctly different appearance. This yarn differs over that of the previous embodiment in that the effect strand E is a continuous multifilament yarn rather than a spun yarn. As in the previously described yarn, the yarn of FIGS. 6–8 has a foundation strand F formed of spun staple fibers, with an effect strand E wrapped about the foundation strand, and with certain areas of the effect strand forming random length multiple layer deposits about the foundation strand. The loops formed by the continuous multifilament effect yarn have a distinctly different appearance from loops formed by a spun effect yarn. A continuous multifilament yarn conventionally has a relatively low twist as compared to a spun yarn. Consequently, when the continuous filament effect yarn forms loops, the individual filaments comprising the multifilament yarn tend to blossom apart and form a multiplicity of individual filament loops, indicated at 26, presenting a fuzzy appearance to the loop. As in the previous embodiment, the loops occur at opposite ends of the multiple layer deposits, with the loops extending away from one another in opposite directions and projecting angularly from the foundation strand F.

The yarns described thus far contain only a single effect strand. However, yarns in accordance with this invention may also contain a plurality of effect strands, and such yarns may exhibit a variety of visually appealing but distinctly different appearances. The effect strands may be of the same or of differing characteristics. For example, the novelty yarn can contain one or more spun effect yarns and one or more continuous multifilament effect yarns. Further, the effect yarns may be of differing color, composition, or filament cross section, or they may be of different size or contain different numbers of filaments.

Figure 9:
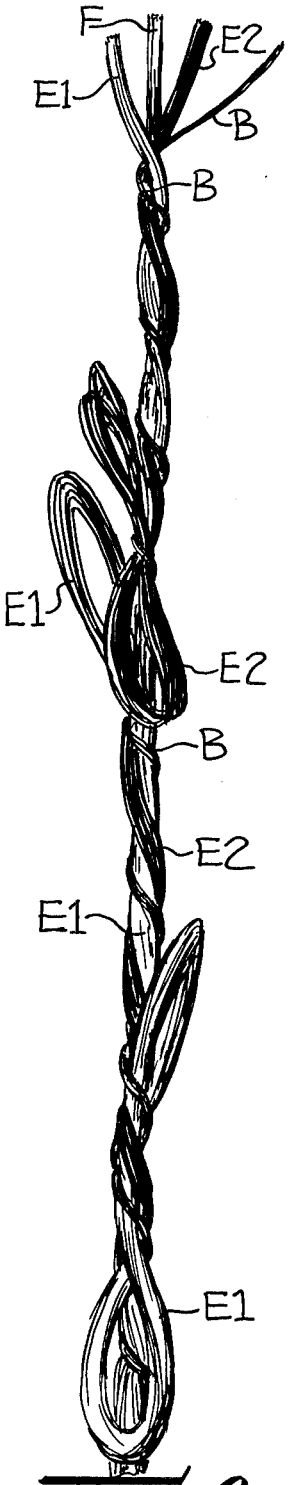
FIG. 9 is an enlarged scale view of still another embodiment of a novelty yarn in accordance with the present invention and wherein the yarn has two effect yarns of different colors.

FIG. 9 illustrates one of the many variations in appearance which can be achieved by employing a plurality of effect yarns of different characteristics. The novelty yarn of FIG. 9 includes two continuous multifilament effect yarns, E1, E2, both of which are wrapped about a foundation strand F formed of spun staple fibers. The two effect yarns E1 and E2 are wrapped about the foundation strand in a common wrapped direction and the effect yarns E1, E2 are bound to the underlying foundation strand F by a binder yarn B which is wrapped about the foundation strand F and the effect strands E1, E2 in the same wrapped direction. The binder strand is a relatively fine denier continuous multifilament yarn.

In the particular yarn illustrated in FIG. 9 the continuous filament effect yarn E1, E2 are of different color and result in the yarn having a mixed color appearance along its length and with loops of different color randomly appearing along the yarn. As in the yarn of FIGS. 6–8, the continuous filament effect yarns in the yarn of FIG. 9 are of relatively low twist as is conventional, and permit the individual filaments in the loops to blossom apart and form a multiplicity of individual filament loops presenting a fuzzy appearance to the yarn where the loops occur.

Additional variations of appearance can be achieved by employing as the effect strand or strands a yarn which itself is a novelty yarn, as for example a slub yarn, or a yarn having variations of color along its length, as for example a space-dyed yarn. If desired, the binder strand could be selected of such a size, color, composition, etc. so as to also contribute to the novelty appearance of the overall yarn. Variations in the foundation strand may also contribute to the novelty appearance of the yarn. The foundation strand may, for example, comprise a continuous filament strand, a strand formed of staple fibers, or a mixture of continuous filaments and staple fibers. If desired, the foundation strand may itself be a novelty yarn, as for example a slub yarn, or a yarn having variations of color along its length. From the foregoing, it will be readily appreciated that the novelty yarns of the present invention can exhibit a nearly infinite number of variations of appearance.

The yarns described above are produced in a simple and economical manner using conventional textile machinery which is readily available in a yarn mill. The drawings and the detailed description which follows illustrate how the method is carried out on a conventional ring spinning frame with minimal modifications being made thereto. From this description it should become readily apparent to those skilled in the art how the present method could be carried out on other conventional textile machines adapted for processing yarns, such as twisters and open end spinning machines for example.

Figure 10:
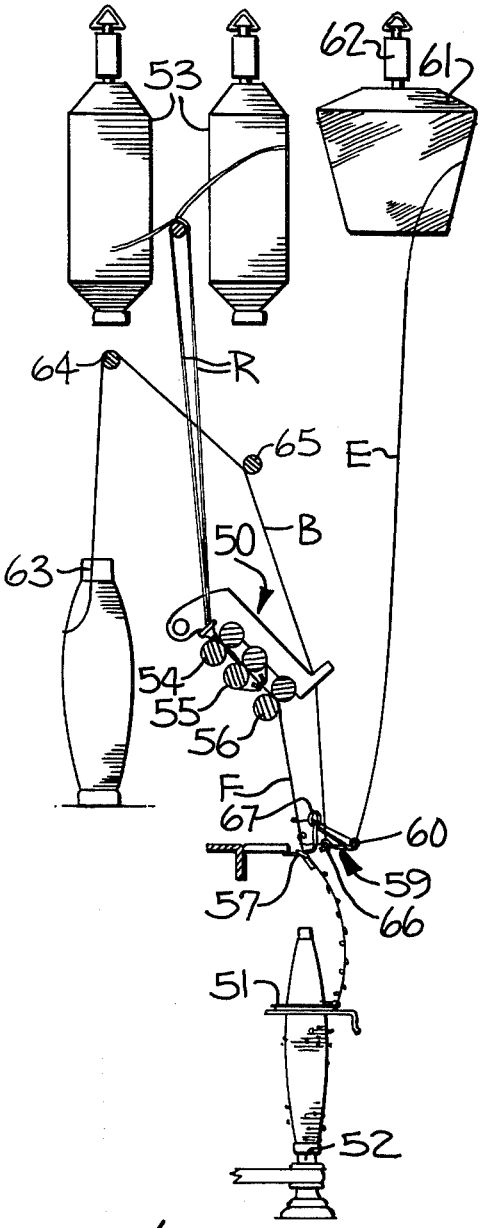
FIG. 10 is a schematic view of how the method of the present invention may be carried out on a conventional textile spinning frame to produce a novelty yarn such as that illustrated in FIGS. 1–5.
Figure 11:
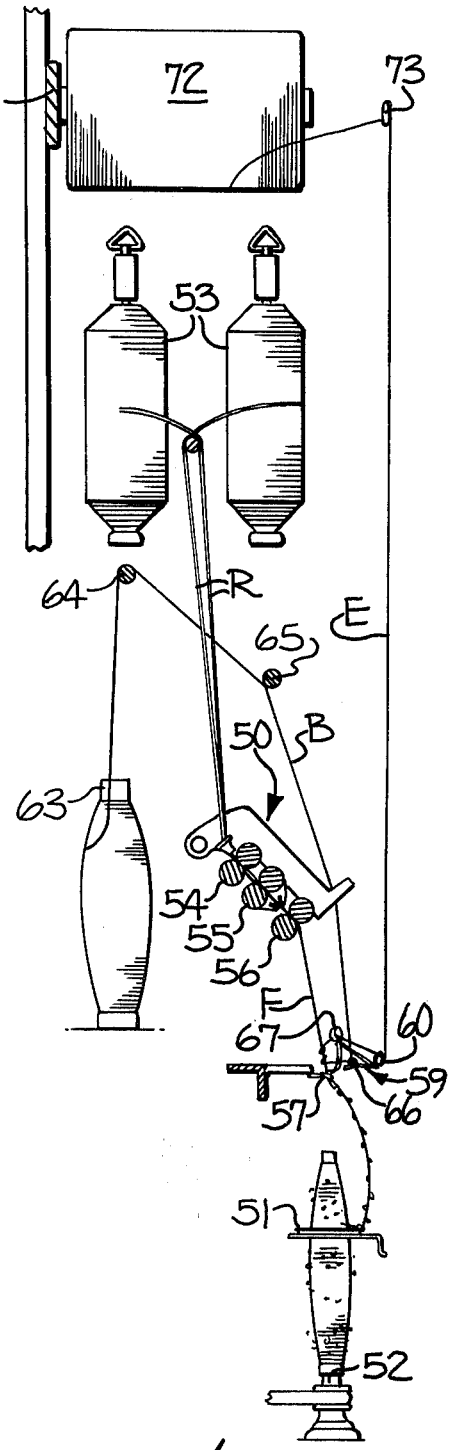
FIG. 11 is a view similar to FIG. 10 showing how the method of the present invention may be carried out to produce a novelty yarn such as that illustrated in FIGS. 6–8.

Referring now more particularly to the drawings, FIGS. 10 and 11 schematically illustrate a conventional ring spinning frame including a drafting zone 50, a reciprocating ring 51, and a rotating spindle 52 where the yarn is wound to form a package. As is conventional, one or more rovings R are directed from their supply packages 53 and to the drafting zone 50 where they are drafted by a series of cooperating pairs of drafting rolls 54, 55, 56 and form a single strand of staple fibers. Upon leaving the delivery rolls 56 of the drafting zone, the strand is directed through a pigtail yarn guide 57 to the ring 51, and thence to the spindle 52 where it is wound on a yarn carrier mounted on the spindle.

As is well known, the rotating spindle 52 causes twist to be imparted to the strand as it advances from the drafting zone to the spindle. The twist imparted to the advancing yarn backs up along the advancing strand to the delivery rolls of the drafting zone. Thus, the area between the delivery rolls 56 and the spindle 52 may be viewed as a twisting zone where twist is imparted to the advancing strand.

The strand of staple fibers delivered from the drafting zone serves as the foundation strand F or core in the novelty yarn of the present invention. One or more effect strands E are directed onto the foundation strand F as it advances in the twisting zone between the delivery rolls 56 and the pigtail yarn guide 57 located just above the spindle. As a result of the twist being imparted to the foundation strand, the effect strand E will become wound about the foundation strand F.

In order to cause the effect strand E to form the projecting loops which are a characteristic feature of the novelty yarn of this invention, it is very important that the effect strand be supplied to the foundation strand under very low tension. When the tension in the effect strand is sufficiently low, the effect strand will move in an unpredictable oscillating manner along the foundation strand while becoming wound about the foundation strand and while at random intervals forming multiple layer deposits of effect strand having outwardly projecting loops of random size.

When the effect strand is combined with the foundation strand as described, it will have a tendency to move upwardly along the foundation strand as it "rides" up the twist of the foundation strand. If completely unrestrained, the effect strand would ride up the foundation strand all the way to the delivery rolls of the drafting zone, and with the effect strand tension sufficiently low, the effect strand would move in such a manner as to produce a loop-type novelty yarn in accordance with this invention.

However, the preferred manner of combining the effect strand with the foundation strand involves passing the effect strand through a guide 60 located downstream from the delivery rolls 56 and closely adjacent the path of travel of the foundation strand from the delivery rolls to the pigtail guide 57. This reduces the likelihood of the effect strand becoming entangled with or broken by the surrounding structure of the drafting rolls, and the guide 60 further provides enhanced control over the formation of loops.

The effect strand E, upon passing through the guide 60, moves in an unpredictable oscillating manner up and down along the advancing foundation strand F while becoming wound about the foundation strand and resulting in the effect strand becoming wound upon itself in certain random areas to form multiple layer deposits of effect strand around the foundation strand. It will be understood that if the effect strand did not oscillate with respect to the advancing foundation strand, the effect strand would become uniformly wound in a single layer about the advancing foundation strand. However, because of the irregular up and down movement of the effect strand, the effect strand sometimes becomes wound upon itself about the foundation strand in multiple layers. The loops appear to be formed when the oscillating effect strand reverses direction, e.g. from up to down or from down to up. Thus, the loops primarily occur at the ends of the multiple layer deposits.

In order to achieve the needed low level of tension in the effect strand, the amount of contact of the effect strand with friction surfaces should be minimized. It has been found desirable to mount the supply package for the effect strand in an elevated location and to provide an essentially unrestricted path of travel for the effect strand from the supply package to the guide. Preferably, the effect strand is allowed to freely fall from the supply package downwardly to the guide.

Thus, as illustrated in FIG. 10 where the effect strand E comprises a spun yarn, a cone 61 of spun yarn is suspended from an elevated support 62 in an inverted vertical orientation so that the effect yarn can freely unwind from the lower side of the cone and fall along an unrestrained path of travel to the guide 60. This results in the effect strand E being delivered to the foundation strand in a nearly tensionless condition. Attempts have been made to measure the tension in a spun effect yarn delivered to the foundation yarn in the manner illustrated in FIG. 10, but the tension was so low as to be incapable of measurement on conventional yarn tension measurement instruments. It has been observed that an effect strand tension of only one gram may be excessive and may prevent the formation of the characteristic loops of the novelty yarn of this invention.

FIG. 11 illustrates an arrangement for producing novelty yarns such as those shown in FIGS. 6–8 wherein the effect strand is a continuous multifilament yarn. This arrangement differs over that of FIG. 10 in the mounting of the supply package for the continuous filament effect yarn. Because of the size of a package of continuous multifilament yarn and the fact that a continuous filament yarn will quite freely unreel from its package, sometimes merely on account of its own weight, it is impractical to mount the continuous filament yarn package in a suspended vertical orientation as is done with a cone of spun yarn as illustrated in FIG. 10. Thus, as shown in FIG. 11 a creel 71 mounts the yarn package 72 in a horizontally extending axial orientation. The effect yarn is pulled off of the end of the package and passes through a guide 73, and then is allowed to freely fall downwardly to the guide 60.

A short distance downstream from where the effect strand E is brought onto the foundation strand F, a binder strand B is directed onto the foundation strand and caused to become wound about the foundation strand and the effect strand so as to bind the effect strand to the underlying foundation strand. Preferably, the binder strand B is a relatively fine denier continuous multifilament yarn. As illustrated, the binder strand is directed from a supply package 63 and over a series of guides, such as guide rods 64 and 65 as illustrated, and thence through a yarn guide 66 located closely adjacent the advancing foundation strand and onto the advancing foundation strand. Preferably, the binder strand is looped around one or more of the guides 64, 65 so as to tension the binder strand and cause it to become wound substantially uniformly about the foundation and effect strands for firmly binding the effect strand to the foundation strand.

Because of the exceedingly low tension in the effect strand, the effect strand is very loosely deposited and wound on the foundation strand and for this reason it is important that the effect strand be bound in place before becoming disturbed or disarranged. Accordingly, the binder strand is directed onto the advancing foundation strand a very short distance after the introduction of the effect strand. While a certain number of the loops formed by the effect strand may be trapped or bound by the binder strand, the vast majority of the loops escape the binder strand and remain in an outwardly projecting relationship after application of the binder strand. This is attributable at least in part to the close proximity of the application of the binder strand and the fact that the foundation strand with the effect strand wrapped thereabout are undergoing twisting as the binder strand is applied and the effect strand loops are thereby held outwardly by centrifugal force.

Figure 12:
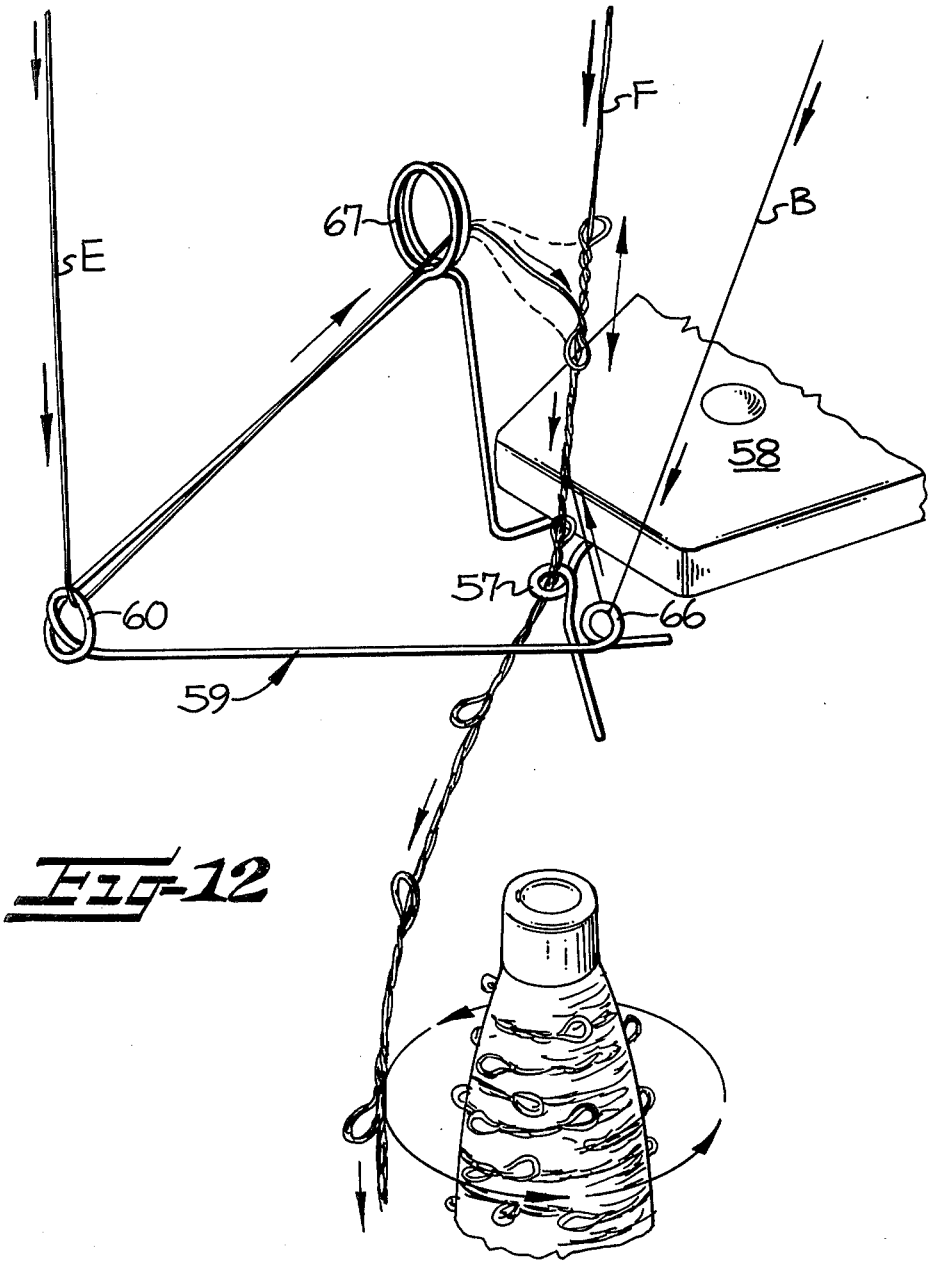
FIG. 12 is a detailed perspective view showing how an effect strand and a binder strand are combined with a foundation strand to produce the unique novelty yarn of this invention.

FIG. 12 illustrates a preferred arrangement for guiding and directing the effect strand E and the binder strand B onto the advancing foundation strand F. As illustrated, the advancing foundation strand passes downwardly through the pigtail guide 57 which is conventionally provided on a spinning frame. An additional strand guide device, generally indicated by the reference character 59, is mounted to the same support 58 to which the pigtail guide 57 is mounted. Guide 59 is formed from wire or other suitable material and includes a relatively large guide 67 in the form of an eye, the purpose of which will be explained later, a relatively small effect strand guide 60, and a binder strand guide 66. Binder strand guide 66 is located a short distance below the effect strand guide 60 and closer to the path of travel of the foundation strand than the guide 60. The guide 67 is located slightly higher than the effect strand guide 60 and also located closer to the path of travel of the advancing foundation strand.

As indicated earlier, the effect strand E will move in an oscillating manner up and down along the foundation strand F between the effect yarn guide 60 and the location where the effect strand joins the advancing foundation strand F and will wrap itself about the advancing foundation strand forming multiple layer deposits of effect strand with random size loops extending therefrom. The size and spacing of the loops will vary depending upon a number of factors such as the type of effect strand, its tension when directed onto the foundation strand, and the distance of the effect strand guide from the path of travel of the foundation strand. These parameters may be adjusted as desired to control the average size and spacing of the random size and random spaced loops being formed.

A further way of controlling the size and spacing of the loops in accordance with the present invention involves limiting the amplitude of oscillating movement of the effect strand by engaging the effect strand between the guide 60 and the foundation strand. As illustrated in FIG. 12 this may be suitably accomplished by passing the effect strand through a second guide 67 located closer to the path of travel of the foundation strand. As illustrated, the second guide 67 is in the form of a circular eye and is of considerably larger diameter than the effect strand guide 60. The effect strand, in its oscillating movement, will periodically move upwardly in the guide 67 until further upward movement is limited by the guide, and the effect strand will then rapidly fall. This is repeated in a rapid and unpredictable manner during the formation of the multiple layer deposits and the loops on the foundation yarn.

In some circumstances it may be desirable to bypass the effect strand guide 60 altogether and to direct the effect strand only through the guide 67. This will result in a less restricted angle of oscillating movement of the effect strand between the guide 67 and the path of travel of the foundation strand and will generally produce larger loops having approximately the same spacing as before.

When two or more effect strands are directed onto the foundation strand, the effect strands may be directed through the same or through different guides. Surprisingly, even when the effect strands pass through the same guide, the various strands each move independently of one another so that the multiple layer deposits and the loops formed thereby are disposed completely at random along the foundation strand.

In the drawings and specification, there have been set forth preferred embodiments of the invention, and although specific terms are employed, they are used in a generic and descriptive sense only and not for purposes of limitation.

That which is claimed is:

1. A novelty yarn characterized by having random size loops disposed at random locations therealong and comprising a foundation strand, an effect strand wrapped about said foundation strand, certain areas of said effect strand forming random length multiple layer deposits around said foundation strand at randomly spaced locations along the foundation strand with portions of the effect strand projecting outwardly from the multiple layer deposits and forming random size loops and a binder strand wrapped about the foundation strand and about the effect strand and serving to bind the effect strand to the underlying foundation strand.

2. A novelty yarn according to claim 1 wherein said areas of the effect strand forming random length multiple layer deposits around said foundation strand are separated by random length areas in which the effect strand is wrapped in a single layer about the foundation strand.

3. A novelty yarn according to claim 2 wherein said areas of the effect strand forming random length multiple layer deposits comprise the major portion of the length of the yarn.

4. A novelty yarn according to claim 1 wherein most of the random length multiple layer deposits along said foundation strand have loops projecting from opposite ends of the multiple layer deposits.

5. A novelty yarn according to claim 4 wherein said loops projecting from opposite ends of the multiple layer deposits extend generally in opposite directions from one another and angularly outwardly from the foundation strand.

6. A novelty yarn according to claim 1 wherein said effect strand and said binder strand extend about said foundation strand in the same wrapped direction.

7. A novelty yarn according to claim 1 wherein said effect strand comprises a continuous multifilament yarn and the loops formed thereby comprise a multiplicity of individual filament loops blossomed apart to present a fuzzy appearance.

8. A novelty yarn according to claim 1 wherein said effect strand comprises a spun yarn.

9. A novelty yarn according to claim 1 comprising at least one additional effect strand wrapped about said foundation strand and bound thereto by said binder strand, and wherein certain areas of said additional effect strand also form random length multiple layer deposits around said foundation strand at randomly spaced locations along the foundation strand and also have portions projecting outwardly from the multiple layer deposits and forming random sized loops.

10. A novelty yarn according to claim 9 wherein said effect strands are of different characteristics.

11. A novelty yarn according to claim 9 wherein said effect strands comprise at least one spun yarn and at least one continuous multifilament yarn.

12. A novelty yarn according to claim 9 wherein all of said effect strands comprise spun yarns.

13. A novelty yarn according to claim 9 wherein all of said effect strands comprise continuous multifilament yarns.

14. A novelty yarn characterized by having random size loops disposed at random locations therealong and comprising a foundation strand formed of spun staple fibers twisted in a predetermined direction, an effect strand wrapped about said foundation strand and extending in a wrapped direction corresponding to the direction of twist in the foundation strand, certain areas of said effect strand forming random length multiple layer deposits around said foundation strand at randomly spaced locations along the foundation strand with portions of the effect strand projecting outwardly from the multiple layer deposits and forming random size loops, and a binder strand wrapped about the foundation strand and about the effect strand and serving to bind the effect strand to the underlying foundation strand.

15. A novelty yarn according to claim 14 wherein said binder strand also extends about the foundation strand in a wrapped direction corresponding to the direction of twist in the foundation strand.

16. A novelty yarn according to claim 15 wherein said effect strand comprises a spun yarn and said binder strand comprises a relatively fine denier continuous filament yarn.

17. A novelty yarn according to claim 15 wherein said effect strand comprises a continuous filament yarn and said binder strand comprises a relatively fine denier continuous filament yarn.

18. A novelty yarn characterized by having random size loops disposed at random locations therealong and comprising a foundation strand formed of spun staple fibers, a plurality of effect strands wrapped about said foundation strand, certain areas of said effect strands forming random length multiple layer deposits around said foundation strand at randomly spaced locations along the foundation strand with portions of the effect strands projecting outwardly from the multiple layer deposits and forming random size loops, and a relatively fine denier continuous filament binder strand wrapped about the foundation strand and about the effect strands and extending in the same wrapped direction as the effect strands and serving to bind the effect strands to the underlying foundation strand.

19. A novelty yarn according to claim 18 wherein said effect strands are of different characteristics.

20. A novelty yarn according to claim 19 wherein said effect strands comprise at least one spun yarn and at least one continuous multifilament yarn.

21. A novelty yarn according to claim 18 wherein all of said effect strands comprise spun yarns.

22. A novelty yarn according to claim 18 wherein all of said effect strands comprise continuous multifilament yarns.

23. A method of forming a novelty yarn having random sized loops disposed at randomly spaced locations therealong, said method comprising advancing a foundation strand along a predetermined path of travel through a twisting zone and imparting twist to the foundation strand while directing an effect strand onto the advancing foundation strand in the twisting zone and causing the effect strand to move in an oscillating manner along the advancing foundation strand and to become wound about the foundation strand while at random intervals forming multiple layer deposits having outwardly projecting loops of random size along the foundation strand and while directing a binder strand onto the foundation and effect strands while in the twisting zone and causing the binder strand to become wound thereabout to bind the effect strand to the underlying foundation strand.

24. A method according to claim 23 wherein the step of directing the effect strand onto the advancing foundation strand comprises directing the effect strand from a supply source and along an unrestrained path of travel and into engagement with a guide located closely adjacent the path of travel of the foundation strand through the twisting zone and thence from the guide onto the advancing foundation strand.

25. A method according to claim 24 wherein the supply source for the effect strand is located above the twisting zone and the step of directing the effect strand along an unrestrained path of travel comprises allowing the effect strand to freely fall from the supply source downwardly to the guide.

26. A method according to claim 23 wherein the step of directing the effect strand onto the advancing foundation strand comprises directing the effect strand into engagement with a guide located closely adjacent the path of travel of the foundation strand through the twisting zone while limiting the amplitude of oscillating movement of the effect strand by engaging the effect strand between the guide and the foundation strand.

27. A method according to claim 23 comprising directing at least one additional effect strand onto the advancing foundation strand in the twisting zone and causing said additional effect strand to also move in an oscillating manner along the advancing foundation strand and to become wound about the foundation strand while at random intervals forming outwardly projecting loops of random size along the foundation strand, and wherein the step of directing a binder strand onto the foundation and effect strands binds all of the effect strands to the underlying foundation strand.

28. A method according to claim 27 wherein effect strands of different characteristics are directed onto the advancing foundation strand.

29. A method of forming a novelty yarn having random sized loops disposed at random spaced locations therealong, said method being performed on a conventional spinning frame and comprising the steps of advancing a foundation strand formed of spun staple fibers from the drafting zone of a spinning frame to a spindle while imparting twist to the foundation strand and winding the foundation strand onto a yarn carrier mounted on the spindle, while directing an effect strand from a supply source and onto the advancing foundation strand at a location between the drafting zone and the spindle and causing the effect strand to move in an oscillating manner along the advancing foundation strand and to become wound about the foundation strand while at random intervals forming multiple layer deposits having outwardly projecting loops of random size along the foundation strand, and while directing a binder strand onto the foundation and effect strands and causing the binder strand to become wound thereabout to bind the effect strand to the underlying foundation strand prior to winding on the yarn carrier.

30. A method according to claim 29 wherein the directing of the effect strand onto the advancing foundation strand causes the effect strand to become wound in a wrapped direction corresponding to the direction of twist in the foundation strand.

31. A method according to claim 30 wherein the directing of the binder strand onto the foundation and effect strands causes the binder strand to also become wound in a wrapped direction corresponding to the direction of twist in the foundation strand.

32. A method according to claim 29 wherein the step of directing the effect strand onto the advancing foundation strand comprises directing the effect strand from the supply source and into engagement with a guide located closely adjacent the path of travel of the foundation strand from the drafting zone to the spindle and thence from the guide onto the advancing foundation strand.

33. A method according to claim 32 wherein the step of directing the effect strand onto the advancing foundation strand comprises the further step of limiting the amplitude of oscillating movement of the effect strand by engaging the effect strand between the guide and the foundation strand.

34. A method according to claim 29 wherein the step of directing the effect strand onto the advancing foundation strand comprises directing the effect strand from the supply source and along an unrestrained path of travel and into engagement with a guide located closely adjacent the path of travel of the foundation strand from the drafting zone to the spindle and thence from the guide onto the advancing foundation strand.

35. A method according to claim 34 wherein the supply source for the effect strand is located above the drafting zone and the step of directing the effect strand along an unrestrained path of travel comprises allowing the effect strand to freely fall from the supply source downwardly to the guide.

36. A method according to claim 29 comprising directing at least one additional effect strand onto the advancing foundation strand at a location between the drafting zone and the spindle and causing said additional effect strand to also move in an oscillating manner along the advancing foundation strand and to become wound about the foundation strand while at random intervals forming outwardly projecting loops of random size along the foundation strand, and wherein the step of directing a binder strand onto the foundation and effect strands binds all of the effect strands to the underlying foundation strand.

* * * * *